US009650165B2

(12) United States Patent
Gabler

(10) Patent No.: US 9,650,165 B2
(45) Date of Patent: May 16, 2017

(54) TRAY SEALER

(71) Applicant: Multivac Sepp Haggenmüller GmbH & Co. KG, Wolfertschwenden (DE)

(72) Inventor: Albert Gabler, Wolfertschwenden (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 710 days.

(21) Appl. No.: 14/020,810

(22) Filed: Sep. 7, 2013

(65) Prior Publication Data

US 2014/0069054 A1 Mar. 13, 2014

(30) Foreign Application Priority Data

Sep. 10, 2012 (EP) ..... 12006350

(51) Int. Cl.

| | |
|---|---|
| ***B65B 35/36*** | (2006.01) |
| ***B65B 35/40*** | (2006.01) |
| ***B65B 7/16*** | (2006.01) |
| ***B65B 43/46*** | (2006.01) |
| ***B65B 43/48*** | (2006.01) |

(52) U.S. Cl.

CPC ..... *B65B 7/162* (2013.01); *B65B 7/16* (2013.01); *B65B 43/46* (2013.01); *B65B 43/48* (2013.01)

(58) Field of Classification Search

CPC ..... B65B 43/46; B65B 43/48; B65B 35/36; B65B 35/40; B65B 35/405; B29C 66/8221; B65G 47/90; B65G 47/91; B65G 47/915

USPC .... 53/329; 198/468.1, 468.3, 741, 742, 429, 198/430, 468.2, 468.4; 414/222.01, 738, 414/739, 741

See application file for complete search history.

(56) References Cited

U.S. PATENT DOCUMENTS

| | | | | | |
|---|---|---|---|---|---|
| 2,730,279 | A | * | 1/1956 | Enock | B65B 21/18 414/416.05 |
| 3,608,744 | A | * | 9/1971 | Ward | C03B 35/125 198/803.7 |
| 4,121,404 | A | * | 10/1978 | Davis | B65B 7/165 53/329 |
| 4,473,098 | A | * | 9/1984 | Sawvel | B65B 43/59 141/131 |
| 4,891,928 | A | * | 1/1990 | James | B65B 43/52 198/836.1 |
| 4,974,392 | A | * | 12/1990 | Mondini | B65B 7/164 198/468.1 |
| 5,024,575 | A | * | 6/1991 | Anderson | B65G 47/90 294/2 |
| 5,475,965 | A | * | 12/1995 | Mondini | B29C 65/02 198/468.1 |
| 5,862,646 | A | * | 1/1999 | Orillo | B65B 5/08 198/345.1 |

(Continued)

FOREIGN PATENT DOCUMENTS

| | | |
|---|---|---|
| CN | 101448706 A | 6/2009 |
| CN | 201301001 Y | 9/2009 |

(Continued)

*Primary Examiner* — Andrew M Tecco
*Assistant Examiner* — Praachi M Pathak
(74) *Attorney, Agent, or Firm* — Husch Blackwell LLP

(57) ABSTRACT

The invention relates to a tray sealer with a gripper system comprising a pivot mechanism with vertically disposed pivot axles to move gripper arms relative to each other and parallel to a transport plane.

12 Claims, 6 Drawing Sheets

(56) References Cited

U.S. PATENT DOCUMENTS 6,056,341 A * 5/2000 Bliss ..... B65G 47/90 294/106
6,722,101 B2 * 4/2004 Hartness ..... B65B 21/183 53/247
6,796,342 B2 * 9/2004 De Antoni Migliorati ..... B67C 7/0053 141/165
7,299,832 B2 * 11/2007 Hartness ..... B65G 17/323 141/144
7,490,883 B2 * 2/2009 Doppenberg ..... B65G 47/90 294/106
7,694,492 B2 * 4/2010 Van Ballegooijen ... B65B 23/02 53/257
8,157,308 B2 * 4/2012 Pedersen ..... B65G 47/90 294/106
8,206,144 B2 * 6/2012 Ng ..... B29C 49/4205 198/803.4
8,240,353 B2 * 8/2012 Vine ..... B65B 7/164 156/538
8,287,015 B2 * 10/2012 Hawes ..... B25J 15/024 294/198
2003/0168872 A1 * 9/2003 Zakula, Sr. ..... B66C 1/30 294/81.51
2009/0301658 A1 * 12/2009 Vine ..... B65B 7/164 156/497
2014/0037402 A1 * 2/2014 Ickert ..... B65G 47/90 414/226.02

FOREIGN PATENT DOCUMENTS

CN 102470933 A 5/2012
DE 2913026 A1 10/1980
EP 0334266 A1 9/1989
EP 1996470 A1 12/2008
EP 2141095 A1 1/2010
WO 2007049145 A1 5/2007
WO 2011018391 A1 2/2011

* cited by examiner

TRAY SEALER

CROSS-REFERENCE TO RELATED APPLICATIONS

This Application claims priority to European Application Number 12006350.8 filed Sep. 9, 2012, to Albert Gabler entitled "Tray Sealer," currently pending, the entire disclosure of which is incorporated herein by reference.

FIELD OF THE INVENTION

The invention relates to a tray sealer (i.e., a tray sealing packaging machine).

BACKGROUND OF THE INVENTION

A tray sealer is known from EP 2 141 095 A1, in which a transfer carriage moves along guides in the direction of transport, and a motion of the gripper arms relative to each other is generated by a rotational motion of the guides.

A tray sealer is known from EP 0 334 266, in which two transfer carriages are arranged laterally below a conveyor belt conveying the trays to a sealing station, and gripper arms are moved towards each other for receiving trays using a pivot lever on each transfer carriage on which a gripper arm is mounted.

A tray sealer is known from EP 1 996 470 in which a gripper system with a carriage, a pivot mechanism, and two gripper arms is provided above the transport plane for the trays and a speed difference between the drive of the carriage and a drive for the pivoting mechanism provides for the movement of the gripper arms towards each other.

A common disadvantage of the above-described tray sealers according to prior art is that the gripper arms are moved towards each other not in parallel, and not at a fixed distance from the transport plane for the trays. Depending on the size of the trays, the gripper arms are moved to a different distance towards each other for receiving the trays and thereby have differing heights relative to the transport plane and thus relative to the tray bottom. Due to a collision with the gripper arms and the sealing tool lower part during the closing motion and the resulting vertical motion, it is hardly possible to grip shallow trays. Due to the lateral dimension of the sealing tool lower part and/or the sealing tool upper part and a limited reach of the gripper arms, narrow trays can only be gripped when the sealing tool lower part and/or the sealing tool upper part with smaller lateral dimensions and adapted gripper arms are simultaneously replaced, in order to be able to move the gripper arms closer to each other.

WO 2011/018 391 shows a tray sealer with horizontal gripper arm adjustment at a transfer carriage being arranged above the transport plane, where drives riding along with the transfer carriage are provided for the gripper arm adjustment. Such a tray sealer has the drawback that the swing of the gripper arms is limited by the guides provided horizontally and transversely to the direction of transport, and that the inertial mass of the transfer carriage is large due to the drives riding along for the gripper arm adjustment.

SUMMARY OF THE INVENTION

It is the object of the present invention to provide a tray sealer with a gripper system that no longer has the drawbacks mentioned.

The tray sealer according to one embodiment of the present invention comprises a closing device, a collection belt, a discharge belt and a gripper system, wherein the gripper system comprises a transfer carriage, guides for the transfer carriage, a linear actuator for driving the transfer carriage, at least two gripper arms, a pivot mechanism for the gripper arms and a pivot drive for driving the pivot mechanism. The pivot mechanism can include vertically disposed pivot axles to move the gripper arms relative to each other and in a plane parallel to a transport plane of trays to be conveyed. This has the advantage that the gripper arms firstly can be at only a very small distance to the transport plane in order to also grip shallow trays. Secondly, a greater lifting motion and a more space-saving design compared to the prior art is possible because the pivot axles are arranged vertically. The support of the pivot axles allows for a very small footprint adjacent to the discharge belt or of the collection belt.

In one embodiment, the pivot mechanism comprises at least one parallelogram linkage for each gripper arm in order to allow a relative motion of the gripper arms to one another during which the gripper arms are permanently oriented in the direction of transport or parallel to each other, respectively.

The transfer carriage can be driven by the linear actuator using a toothed belt drive to minimize the inertia of the moving masses of the gripper system.

The pivot mechanism may be driven by the pivot drive using a first and a second shaft to be able to attach the pivot drive to a machine frame in a stationary manner. This also reduces the moving mass of the gripper system and this embodiment requires less maintenance than a co-moving drive with mechanically stressed power lines.

The vertically disposed pivot axles of the pivot mechanism can be driven by a rotation of the shafts and a lever mechanism provided on the transfer carriage. Depending on the distance of the shafts to each other, high torques can be transmitted from the pivot drive to the pivot mechanism or to the parallelogram linkages, respectively, and thereby to the gripper arms.

The guides for the transfer carriage are provided preferably in the direction of transport downstream of the sealing station, in order to increase the hygienic quality, in that as few components as possible are disposed upstream of the still unsealed trays, for example, on the collection belt on which the trays with the product are open at the top, so that the risk of contamination of the products prior to closing is reduced.

Preferably, the guides and the transfer carriage are provided below the transport plane in order to increase the hygienic quality in that as few components as possible are disposed above the still unsealed trays, for example, on the collection belt.

In one embodiment, the linear actuator and/or the pivot drive comprise a servo motor to reach a highly dynamic range, and to be able to have the two drives be able to perform motions relative to each other with very high accuracy, which is advantageous for the closing motion of the gripper arms. Unlike pneumatic cylinders, all intermediate positions are possible with servo motors during the gripper arm motion.

The pivot axles can be coupled to each other via a lever mechanism such that the parallelogram linkages can be moved synchronously, so that the position of the gripper arms is always centered relative to the closing device or to the trays, respectively.

The gripper arms may be connected to the parallelogram linkage with one of their ends. In this manner, only the gripper arms protrude into the closing device and the transfer carriage with the pivot mechanism moves outside of the closing device. Accordingly, the closure device can be embodied in a space-saving manner.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Identical components are throughout the figures designated with the same reference numerals.

DETAILED DESCRIPTION OF THE INVENTION

Figure 1:
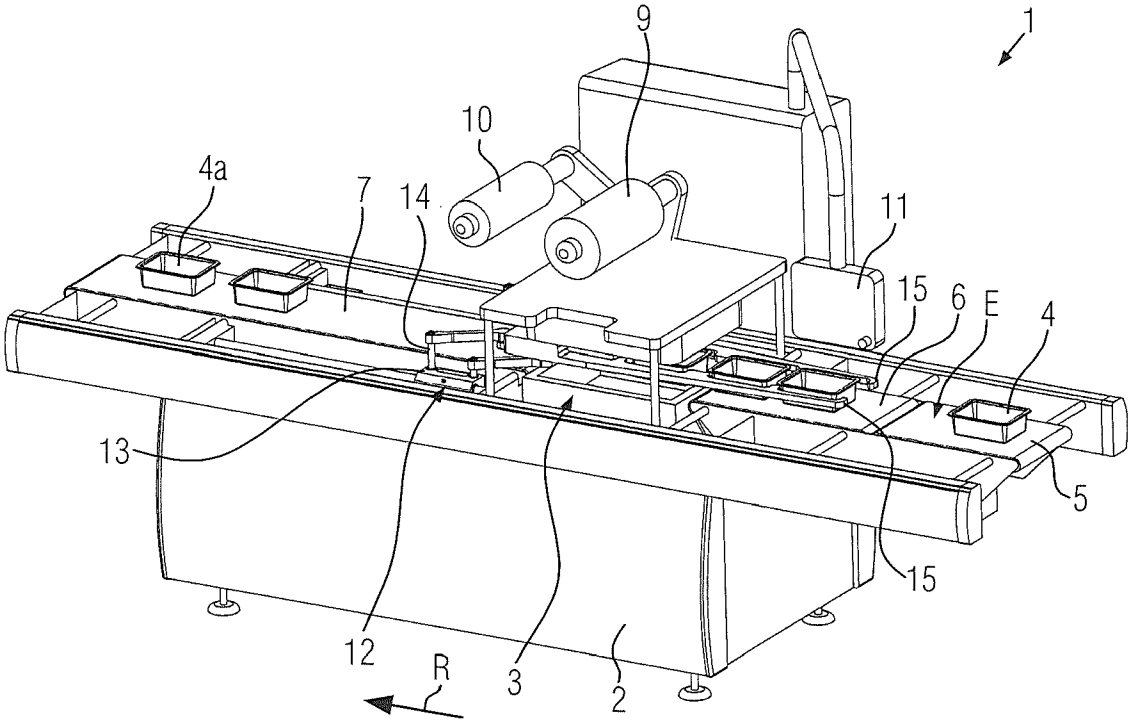
FIG. 1 is a side perspective view of a tray sealer in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a perspective view of a tray sealer (i.e., a tray sealing packaging machine) 1 according to one embodiment of the present invention. The tray sealer 1 comprises a machine frame 2 on which a closing device 3 (e.g., a sealing station) is arranged for closing and possibly for sealing and/or evacuating and/or gas flushing supplied trays 4, as well as for cutting a top film—not shown—used for closing. As show, the packaging machine 1 further comprises a conveyor belt 5 and a collection belt 6 for supplying the trays 4 filled with the product, a discharge belt 7 for conveying the sealed trays 4*a* away, a film feeder roller 9 for taking up and delivering a top film, and a film trim winder 10 for winding the film sheet of the top film that remains after the sealing process. A display 11 allows the operator of the tray sealer 1 to monitor and control the operation of the tray sealer 1. A gripper system 12 can comprise a transfer carriage 13, a pivot mechanism 14 and two gripper arms 15. The motion of the gripper system 12 in and against a direction of transport R can be performed from the collection belt 6 into the closing device 3 for introducing unclosed trays 4, and is performed from the closing device 3 onto the discharge belt 7 for extracting the closed trays 4*a*. The transport surfaces of the belts 6, 7, 8 for the trays 4, 4*a* define the horizontal transport plane E.

Figure 2A:
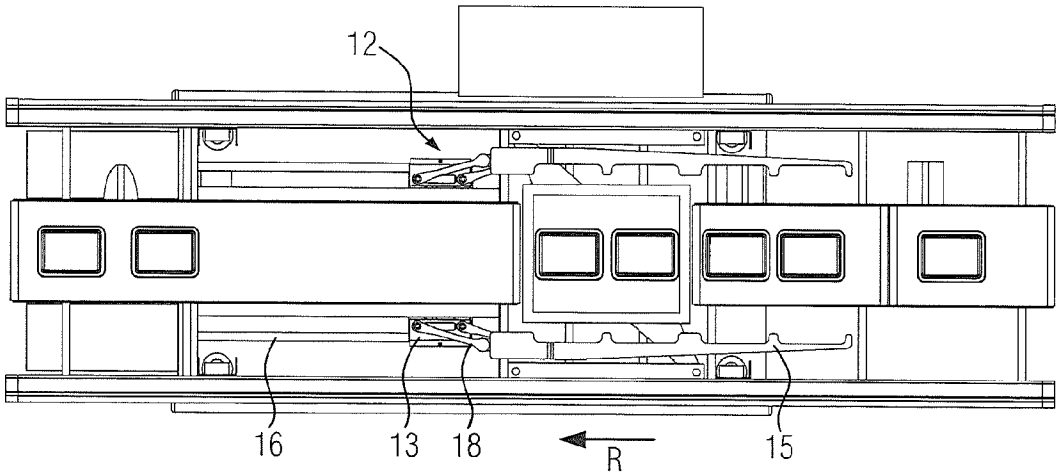
FIG. 2*a* is plan view of a gripper system in the open position in accordance with one embodiment of the present invention.

The mode of operation of the gripper system 12 shall be explained using FIGS. 2*a* to 2*d*. FIG. 2*a* shows a plan view of a gripper system 12 in the open position. The transfer carriage 13 can be movable in the direction of transport R using guides 16 and is driven by a linear actuator 17 (see FIG. 3). The transfer carriage 13 has a pivot mechanism 14 attached (see FIG. 3) which can comprise a parallelogram linkage 18 for each gripper 15. A pivot drive 19 (see FIG. 3) may be provided for closing and opening the gripper arms 15.

Figure 2B:
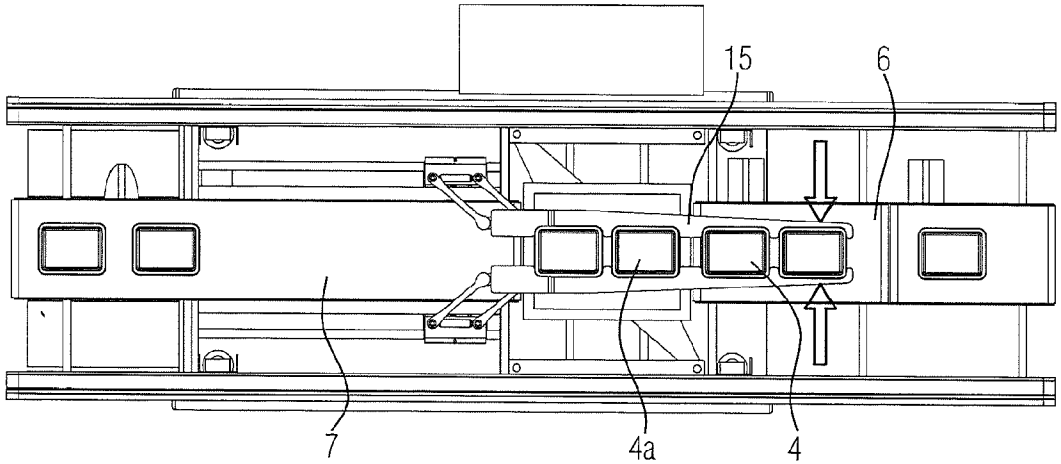
FIG. 2*b* is a plan view of the gripper system of FIG. 2*a* in the closed position for gripping the trays from the feeding belt and a closing device.

After opening the sealing device 3, as shown in FIG. 2*b*, the gripper arms 15 perform a closing motion towards each other in a horizontal plane and grip two trays 4*a* which were closed with a top film, and two trays 4 which were provided on the collection belt 6.

Figure 2C:
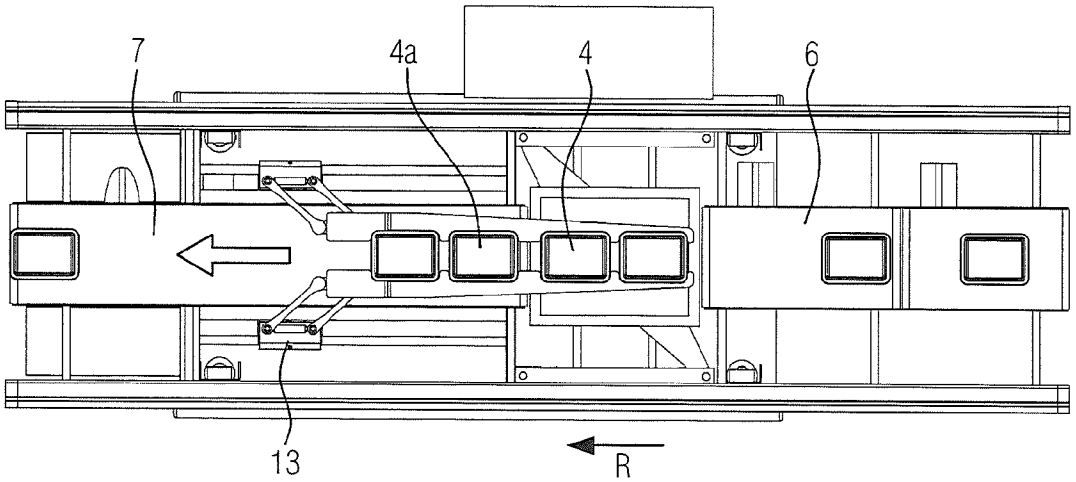
FIG. 2*c* is a plan view of the gripper system of FIG. 2*a* after a motion in the direction of transport.

The transfer carriage 13 can move in the direction of transport R in order to convey the trays 4 from the collection belt 6 into the closing device 3, and the closed trays 4*a* from the closing device 3 via the discharge belt 7, as shown in FIG. 2*c*. The motions are illustrated by arrows.

Figure 2D:
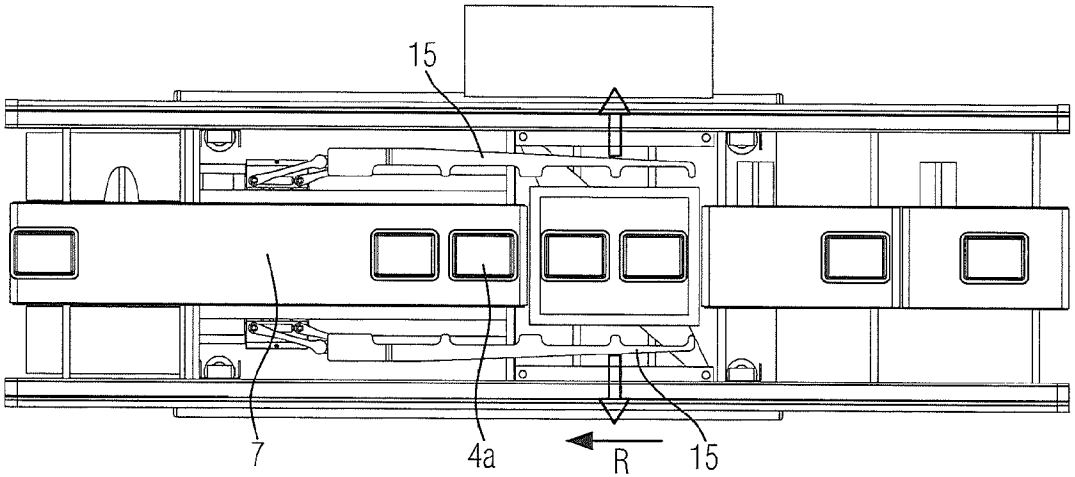
FIG. 2*d* is a plan view of the gripper system of FIG. 2*a* in the open position for placing trays in the closing device and onto the discharge belt.

FIG. 2*d* illustrates how the gripper arms 15 are moved apart, so that the trays 4*a* can be conveyed away on the discharge belt 7 to a next production step, and the new trays 4 can be closed in the closing device 3. This cycle starts over again after the transfer carriage 13 has been moved back in the direction opposite to the direction of transport R.

Figure 3:
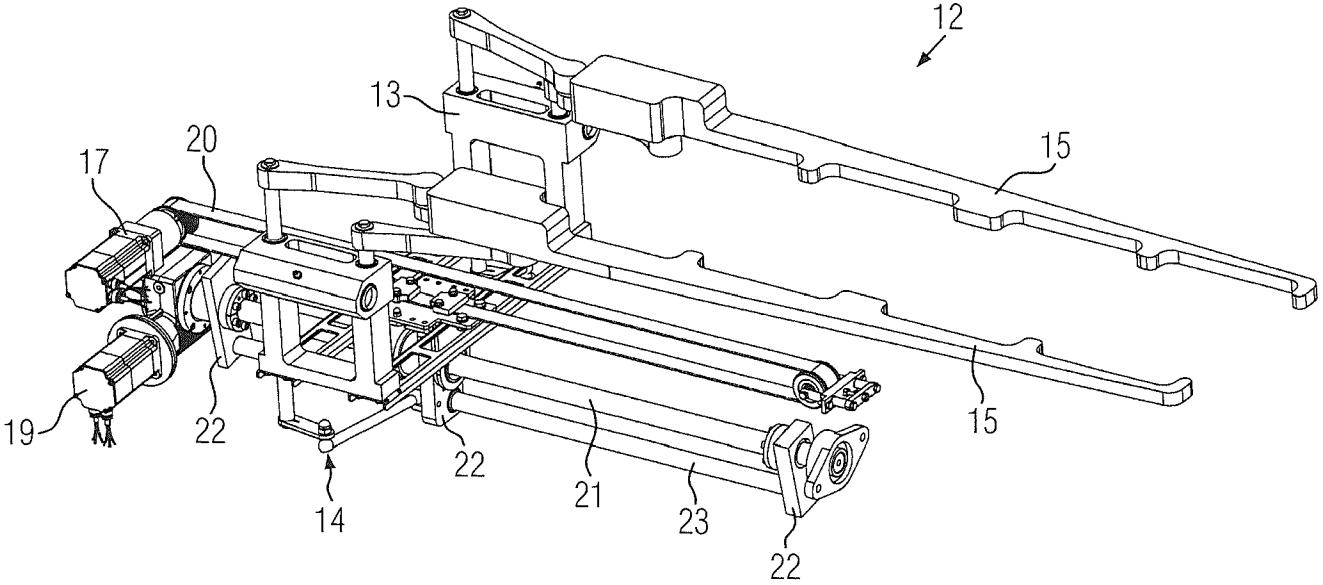
FIG. 3 is a side perspective view of a gripper system as a separate module in accordance with one embodiment of the present invention.

FIG. 3 shows a perspective view of the gripper system 12 as a separate module without the guides 16, but with the transfer carriage 13, the linear actuator 17 and the pivot drive 19 for the closing motion of the gripper arms 15. The linear actuator 17 is attached in a stationary manner to the machine frame 2 and may move the transfer carriage 13 along the guides 16—presently not shown—using a toothed belt drive 20. Alternatively, also flat belts, chains or a spindle drive can be used. The pivot drive 19 is also mounted in a stationary manner on the machine frame 2 and rotates a first shaft 21. By using levers 22 provided at the ends of the first shaft 21, a second shaft 23 may be rotated about the first shaft 21 in order to be able to transmit a torque to the pivot mechanism 14, while the pivot mechanism 14 is guided along the two shafts 21, 23.

Figure 3A:
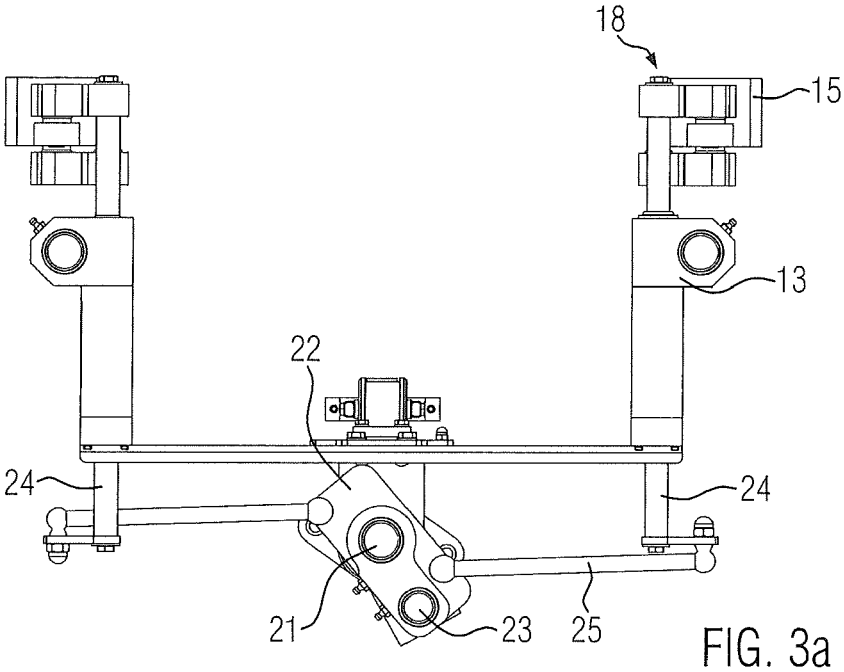
FIG. 3*a* is a sectional view of the gripper system of FIG. 3 from a direction opposite to the direction of transport in a first position.
Figure 3B:
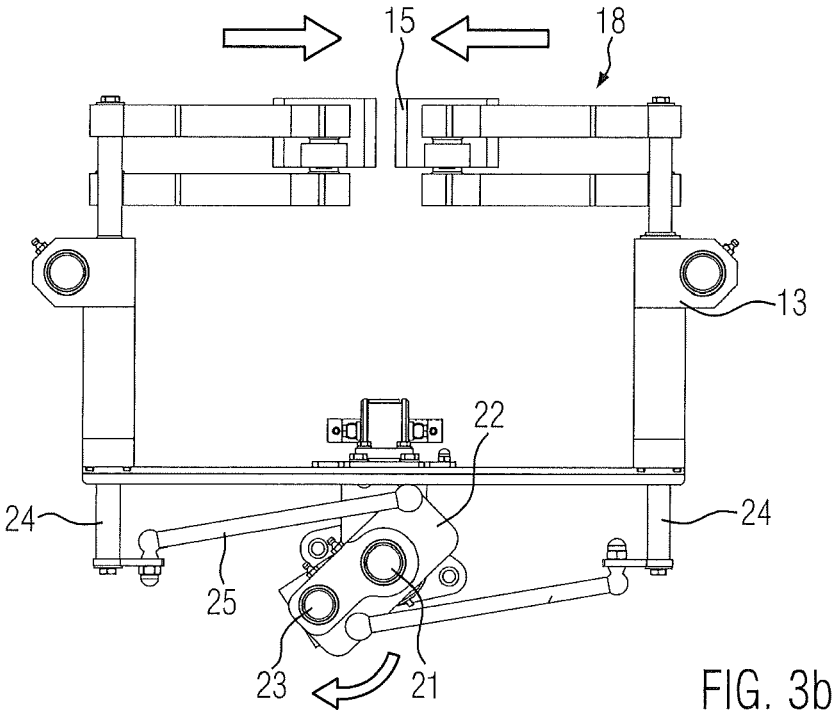
FIG. 3*b* is a sectional view of the gripper system of FIG. 3 from a direction opposite to the direction of transport in a second position.

As is shown in FIGS. 3*a* and 3*b* in a sectional view, the pivot drive 19 can provide a torque transfer, via the two shafts 21, 23 and the lever 22 by using a lever mechanism 25, onto each of the pivot axles 24 of the parallelogram linkage 18, which are in the transfer carriage 13 rotatably mounted. The parallelogram linkage 18 ensures that the gripper arms 15 aligned in parallel to the direction of transport R also move in parallel to each other during the opening and closing motion in order to be able to precisely grip the trays 4, 4*a*. The rotational motion of the lever 22 and the closing of the gripper arms 15 are shown by arrows in FIG. 3*b*.

Figure 4A:
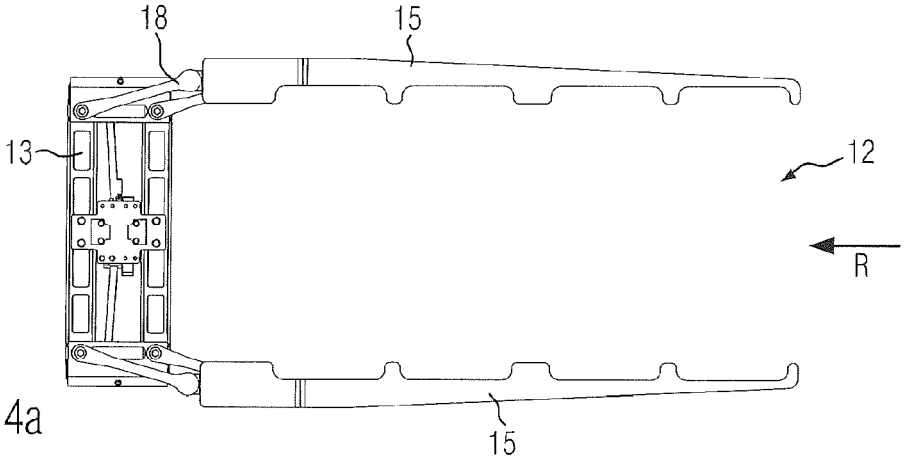
FIG. 4*a* is a plan view of the gripper arms and the pivot mechanism in the open position in accordance with one embodiment of the present invention.
Figure 4B:
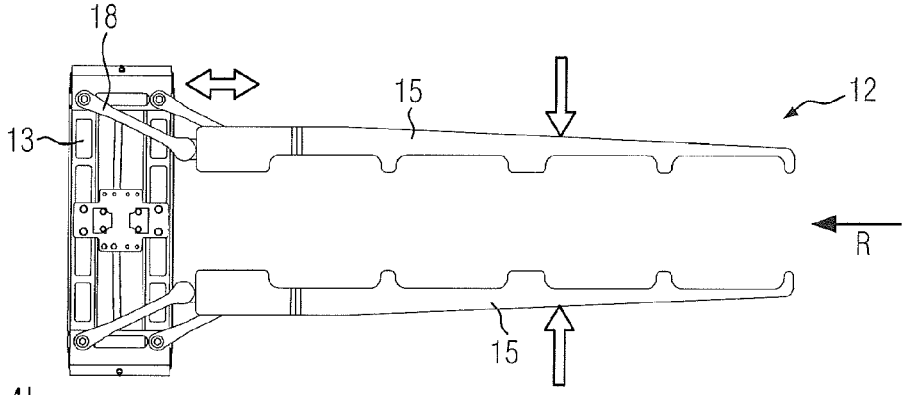
FIG. 4*b* is a plan view of the gripper arms and the pivot mechanism of FIG. 4*a* in an intermediate position.
Figure 4C:
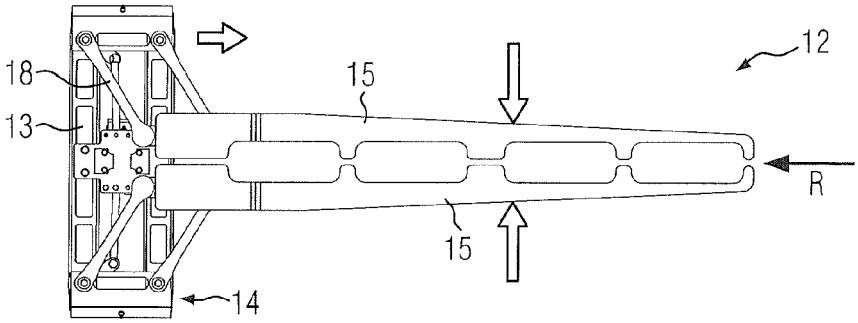
FIG. 4*c* is a plan view of the gripper arms and the pivot mechanism of FIG. 4*a* in the closed position.

The relationship of the motions of the transfer carriage 13 and the gripper arms 15 is explained using FIGS. 4*a*, 4*b* and 4*c*. FIG. 4*a* shows a plan view of a gripper system 12 in the open position. During the closing motion of the gripper arms 15 for gripping the trays (presently not shown), the gripper arms 15 must maintain their position relative to the direction of transport R. During the pivot motion of the parallelogram linkage 18, there is a relative motion of the gripper arms 15 vis-à-vis the transfer carriage 13. This relative motion can be compensated by a motion by the transfer carriage 13. This means that the linear actuator 17 (see FIG. 3) during the closing motion of the gripper arms 15 is coupled to the pivot drive 19 (see FIG. 3), for example, via a common controller, in a manner that such a closing motion of the gripper arms 15 is enabled. Servo motors can be provided for the linear actuator 17 and the pivot drive 19. Furthermore, FIGS. 4*a* and 4*c* show that the space required for the pivot mechanism 14, in particular of the parallelogram linkage 18, is small while it is still possible to grip both very narrow trays 4 as well as very wide trays 4 without having to make any modifications to the gripper system 12. Flexibility is thereby increased and set-up times are reduced.

It is also conceivable that the transfer carriage 13 and the guides 16 are provided below the collection belt 6. FIGS. 1 to 4*c* show a single lane tray sealer 1 for the simultaneous closing of two trays 4. The tray sealer 1 according to the invention can also be embodied as a multi-track tray sealer 1 and is conceivable for any number of trays 4.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. Tray sealer comprising:

a closing device;

a collection belt;

a discharge belt; and a gripper system including:

a transfer carriage moveable between a first position and a second position, and disposed outside the closing device;

at least two guides for said transfer carriage;

a linear actuator for driving said transfer carriage along said at least two guides;

at least two gripper arms, wherein said at least two gripper arms extend from the transfer carriage through the closing device;

a pivot mechanism for moving said gripper arms, wherein said pivot mechanism comprises a plurality of pivot axles, each pivot axle disposed for rotation and having a substantially vertical axis of rotation, and wherein rotation of the plurality of pivot axles translate said at least two gripper arms relative to each other between an open position and a gripping position and in a plane parallel to a substantially horizontal transport plane of the trays; and a pivot drive for driving said pivot mechanism;

and wherein when said at least two gripper arms are disposed in the gripping position, a first portion of said at least two gripper arms is positioned over the collection belt at said first position of the transfer carriage and a second portion of said at least two gripper arms is positioned over the discharge belt at said second position of the transfer carriage.

2. Tray sealer according to claim 1, wherein said pivot mechanism comprises at least one parallelogram linkage operably connected to each of the at least two gripper arms.

3. Tray sealer according to claim 2, wherein said pivot axles are coupled to each other by a lever mechanism such that said at least one parallelogram linkage for each gripper arm can be moved synchronously.

4. Tray sealer according to claim 2, wherein said at least one parallelogram linkage is connected to an end of each respective said at least two gripper arms.

5. Tray sealer according to claim 1, wherein said transfer carriage is drivable by said linear actuator using a toothed belt drive.

6. Tray sealer according to claim 1, wherein said pivot mechanism is drivable by said pivot drive using a first and a second shaft.

7. Tray sealer according to claim 6, wherein one or more of said plurality of pivot axles of said pivot mechanism can be driven by a rotation of one of the first shaft, the second shaft, or a lever mechanism provided on said transfer carriage.

8. Tray sealer according to claim 1, wherein said at least two guides are positioned downstream of said closing device in a direction of transport of said tray sealer.

9. Tray sealer according to claim 1, wherein said at least two guides and said transfer carriage are provided below said transport plane.

10. Tray sealer according to claim 1, wherein said linear actuator and/or said pivot drive comprise a servo motor.

11. A gripper system for a packaging machine, said gripper system comprising:

a transfer carriage;

at least two guides for said transfer carriage;

a linear actuator for driving said transfer carriage along said at least two guides;

at least two gripper arms;

a pivot mechanism for moving said at least two gripper arms, wherein said pivot mechanism comprises at least a first pivot axle and a second pivot axle, each pivot axle disposed for rotation and having a substantially vertical axis of rotation, wherein said first pivot axle is operably connected to a first gripper arm and said second pivot axle is operably connected to a second gripper arm, and wherein rotation of the at least two pivot axles move said first gripper arm and said second gripper arm relative to each other and in a plane parallel to a substantially horizontal transport plane of a plurality of packages of the packaging machine, and wherein said first gripper arm remains substantially parallel to said second gripper arm during said relative movement; and a pivot drive for driving said pivot mechanism.

12. A gripper system for a packaging machine, said gripper system comprising:

a transfer carriage;

at least two guides for supporting and guiding the movement of said transfer carriage;

a linear actuator for selectively moving said transfer carriage relative to said at least two guides in and against a direction of transport of the packaging machine;

a pivot mechanism for moving a first gripper arm and a second gripper arm in a direction substantially perpendicular to the direction of transport of the packaging machine, wherein said pivot mechanism comprises a first pivot axle and a second pivot axle, the first pivot axle being disposed for rotation about a substantially vertical axis of rotation and being operably connected to said first gripper arm by a first linkage, and said second pivot axle being disposed for rotation about a substantially vertical axis of rotation and being operably connected to said second gripper arm by a second linkage, wherein rotation of said first and second pivot axles causes relative movement of said first gripper arm to said second gripper arm in a direction toward or away from each other in a plane parallel to a substantially horizontal transport plane of a plurality of packages of the packaging machine; and a pivot drive for driving said pivot mechanism to cause rotation of said first pivot axle and said second pivot axle;

wherein said first linkage is at least a portion of a first parallelogram linkage and wherein said second linkage is at least a portion of a second parallelogram linkage, wherein the first parallelogram linkage and said second parallelogram linkage are disposed to maintain said first gripper arm in a substantially parallel relationship with said second gripper arm during the relative movement of said first gripper arm and said second gripper arm in said direction toward or away from each other.

* * * * *